US007423533B1

(12) United States Patent
LeBlond et al.

(10) Patent No.: US 7,423,533 B1
(45) Date of Patent: Sep. 9, 2008

(54) SYSTEM FOR MONITORING AND RECORDING CROSS-CONTAMINATION EVENTS

(75) Inventors: Claude W. LeBlond, Irvine, CA (US); Henry M. Ortiz, Aliso Viejo, CA (US)

(73) Assignee: Cognetive Systems, Incorporated, Irvine, CA (US)

( * ) Notice: Subject to any disclaimer, the term of this patent is extended or adjusted under 35 U.S.C. 154(b) by 354 days.

(21) Appl. No.: 11/255,651

(22) Filed: Oct. 19, 2005

Related U.S. Application Data

(60) Provisional application No. 60/620,165, filed on Oct. 19, 2004.

(51) Int. Cl.
*G08B 13/14* (2006.01)

(52) U.S. Cl. ..... 340/572.1; 340/573.1; 340/573.4

(58) Field of Classification Search ..... 340/572.1, 340/573.1, 573.4, 539.1, 505, 506, 521; 700/281, 282, 19; 434/236, 237; 4/668, 4/301

See application file for complete search history.

(56) References Cited

U.S. PATENT DOCUMENTS

| | | | |
|---|---|---|---|
| 3,478,344 | A | 11/1969 | Schwitzgebel et al. |
| 3,764,984 | A | 10/1973 | McCartney |
| 3,805,265 | A | 4/1974 | Lester |
| 4,254,472 | A | 3/1981 | Juengel et al. |
| 4,375,637 | A | 3/1983 | Desjardins |
| 4,538,138 | A | 8/1985 | Harvey et al. |
| 4,567,557 | A | 1/1986 | Burns |
| 4,743,892 | A | 5/1988 | Zayle |
| 4,746,907 | A | 5/1988 | Zehnder, Jr. |
| 4,896,144 | A | 1/1990 | Bogstad |
| 5,202,666 | A | 4/1993 | Knippscheer |
| 5,610,589 | A | 3/1997 | Evans et al. |
| 5,611,465 | A | 3/1997 | Lee et al. |
| 5,691,919 | A | 11/1997 | Gemmell et al. |
| 5,745,049 | A | 4/1998 | Akiyama et al. |
| 5,812,059 | A | 9/1998 | Shaw et al. |
| 5,878,381 | A | 3/1999 | Gemmell et al. |
| 5,900,801 | A | 5/1999 | Heagle et al. |
| 5,905,436 | A | 5/1999 | Dwight et al. |
| 5,910,776 | A | 6/1999 | Black |
| 5,917,425 | A | 6/1999 | Crimmins et al. |
| 5,939,974 | A | 8/1999 | Heagle et al. |
| 5,945,910 | A | 8/1999 | Gorra |

(Continued)

*Primary Examiner*—Van T. Trieu
(74) *Attorney, Agent, or Firm*—Blakely Sokoloff Taylor & Zafman LLP

(57) ABSTRACT

A cross-contamination management system for remotely monitoring of personnel and objects and their use of sanitation facilities in adherence to a managed process with cleansing and sanitizing requirements generally includes a plurality of wireless communication devices with a first number of the wireless communication devices being disposed within or adjacent cleaning devices and operative for monitoring and reporting functional status and operation thereof. A second number of the wireless communication devices disposed in tags suitable for carrying by individuals or attaching to objects. A third number of wireless communication devices being configured to determine if a cleaning device associated with the one of the third number of wireless communication devices is to be ascribed to one of the tags and reporting thereon by an output signal. A fourth number of wireless communication devices being disposed at access points to determine if an object or person traversing access points associated with the fourth number of wireless communication devices is to be ascribed to one of the second wireless communication devices and reporting therein by an output signal.

2 Claims, 3 Drawing Sheets

U.S. PATENT DOCUMENTS 5,952,924 A 9/1999 Evans et al.
5,959,533 A 9/1999 Layson, Jr. et al.
5,973,601 A 10/1999 Campana, Jr.
6,000,429 A 12/1999 Van Marcke
6,002,334 A 12/1999 Dvorak
6,037,871 A 3/2000 Babylon
6,038,331 A 3/2000 Johnson
6,072,396 A 6/2000 Gaukel
6,100,806 A 8/2000 Gaukel
6,124,806 A 9/2000 Cunningham et al.
6,195,006 B1 2/2001 Bowers et al.
6,195,588 B1 2/2001 Gauthier et al.
6,211,788 B1 4/2001 Lynn et al.
6,225,906 B1 5/2001 Shore
6,236,317 B1 5/2001 Cohen et al.
6,236,953 B1 5/2001 Segal
6,353,764 B1 3/2002 Imagawa et al.
6,360,181 B1 3/2002 Gemmell et al.
6,375,038 B1 4/2002 Daansen et al.
6,392,546 B1 5/2002 Smith
6,396,413 B2 5/2002 Hines et al.
6,411,920 B1 6/2002 McConnell et al.
6,426,701 B1 7/2002 Levy et al.
6,532,416 B1 3/2003 Mueller
6,549,816 B2 4/2003 Gauthier et al.
6,701,194 B2 3/2004 Gauthier et al.
6,727,818 B1 4/2004 Wildman et al.
6,796,799 B1 * 9/2004 Yoshiike et al. ..... 434/236
6,882,278 B2 4/2005 Winings et al.
6,895,296 B2 5/2005 Holt et al.
6,898,552 B2 5/2005 Marcichow
6,956,498 B1 10/2005 Gauthier et al.
6,975,231 B2 12/2005 Lane et al.
7,099,649 B2 8/2006 Patterson et al.
7,177,725 B2 * 2/2007 Nortier et al. ..... 700/282
2001/0025349 A1 9/2001 Sharood et al.
2003/0030562 A1 2/2003 Lane et al.
2003/0210140 A1 11/2003 Menard et al.
2004/0012524 A1 1/2004 Couronne et al.
2005/0035862 A1 2/2005 Wildman et al.
2005/0134465 A1 6/2005 Rice et al.
2005/0145745 A1 7/2005 Lewis et al.
2005/0149414 A1 7/2005 Schrodt et al.
2005/0171634 A1 8/2005 York et al.
2005/0197732 A1 9/2005 Holt et al.
2005/0248461 A1 * 11/2005 Lane et al. ..... 340/573.1
2006/0005312 A1 1/2006 Reddy et al.

* cited by examiner

SYSTEM FOR MONITORING AND RECORDING CROSS-CONTAMINATION EVENTS

CROSS-CONTAMINATION EVENTS

The present application claims priority from provisional patent application Ser. No. 60/620,165 filed Oct. 19, 2004 and by this specific reference thereto incorporates the provisional application in total into the present application.

The present invention relates to cross-contamination and the use of sanitation facilities as a process control or service. The system described is a process management system capable of remotely monitoring persons and objects as they traverse boundaries of zones or rooms where segregation of materials within zones is an important process control requirement where contamination of material in one zone by material from another zone is unwanted or where cleaning protocols exist to prevent this cross-contamination.

In addition, the present invention relates to a management system for remotely monitoring of personnel and objects and their use of sanitation facilities in adherence to a sanitization process with cleansing and sanitizing requirements.

Examples of industries where such a system would be useful are:

1) In the manufacturing of microelectronics, pharmaceuticals, bio-tech and sterile products typically performed in a clean-room environment where there is an entry protocol performed that includes cleaning of parts and personnel.

2) In restaurant and institutional food service operations that must control cross-contamination risk factors in the kitchen, focused on poor personal sanitation, contaminated equipment, and the contamination of cooked by raw product. Similar cross-contamination risk factors are pervasive in the food processing industry on an amplified scale.

3) In the health care industry where the CDC estimates that one third of all nosocomial infections are caused by poor adherence to cross-contamination infection control practices involving proper cleaning of equipment and personnel.

In recent years, the public's growing concern with food safety and terrorism has generated increased public awareness of the topic of cleansing, and sanitation in general. The US government is very concerned about the security of the nation's food supply and has issued mandates regarding the standard practices regarding management of production processes, procedures, and their efficacy.

Non-compliance with established sanitation protocol is a serious problem with expensive and sometimes fatal consequences. Each year, food borne illness strikes 76 million people, causes 325,000 hospitalizations, and kills over 5,000.70% of the outbreaks originate in the food service sector. 40% of these are the result of poor hand washing and cross-contamination (oral/fecal).

The annual cost of food borne illness in terms of pain and suffering, reduced productivity, and medical costs are estimated to be as high as $83 billion. Approximately 2 million hospital patients annually become infected while being treated for another illness or injury. Of these 2 million infected patients, approximately 88,000 will die. The CDC estimates that these infections or illnesses, called nosocomial infections, add nearly $4.5 billion to U.S. healthcare costs annually. The CDC also estimates that one third of all nosocomial infections are caused by poor adherence to infection control practices, such as hand washing.

The CDC estimates that nosocomial infections cost on average $35,000 per incidence in extended medical costs. With respect to hospitals and hospital staff, it is estimated that the rate of hand washing non-compliance among healthcare workers is an astonishing 70-80%.

The Food and Drug Administration (FDA) assists the approximately 75 state and territorial agencies and more than 3,000 local departments that assume primary responsibility for preventing food borne illness, and for licensing and inspecting establishments within the retail segment of the food industry. This consists of more than one million establishments, and employs a work force of over 12 million. The FDA maintains a model Food Code to assist food control jurisdictions at all levels of government by providing them with a scientifically sound technical and legal basis for regulating the retail segment of the food industry. According to the model Food Code, a person must wash after using the bathroom, and defines a hand washing process with duration of a minimum 20 seconds with concentration on the fingers and fingernails. In addition to timing the process protocol of washing including the use of soap water is defined. Many operators in commercial food service have expanded on the FDA model with more rigorous protocols.

One approach to aid in cleansing procedure compliance is shown in U.S. Pat. No. 5,945,910. This system employs a sensor for signaling the dispensation of a cleaning agent from a dispenser. A module gives visual prompts to individuals to input identification data manually.

A procedure oriented invention is described in U.S. Pat. No. 6,426,701 B1 that embodies a monitoring module that operates in conjunction with a soap dispenser to track usage by individuals and provides a means of administrator review of the data. A prompting system communicates with a badge.

Another procedure oriented invention is described in U.S. Pat. No. 6,236,317 B1 that embodies a monitoring module that tracks usage of hygienic devices by individuals and provides a prompting system which communicates completion of desired actions with the individual's badge. A means of administrator review of the data is also provided.

An approach to aid the cleansing procedure to address cross-contamination in the food and medical industries is described in U.S. Pat. No. 5,812,059 that embodies a system to eliminate worker contamination that may occur between a cleaning device and the clean area.

In all cases the foregoing examples focus on individuals and hand washing as a hygienic process. The present invention recognizes the importance of objects and apparel as well as individuals in the creation of cross-contamination events and describes a comprehensive system for monitoring the functional status, operational sequence the state and or relationship between the plurality of elements and therefore adherence with a cross-contamination prevention policy as a managed process.

SUMMARY OF THE INVENTION

A cross-contamination monitoring system in accordance with the present invention generally includes a plurality of wireless communication devices with the first number of the wireless communication devices being disposed within or adjacent cleaning devices and operative for monitoring and reporting operation therein by an output signal, thus transmitting the monitoring data generated to a wireless communication module and data server for processing.

A second number of wireless communication devices disposed in tags suitable for carrying by individuals or attaching to objects which uniquely identify the individuals or objects.

A third number of wireless communication devices being disposed within or adjacent cleaning devices and operative for recognizing the presence and uniqueness of the second number of wireless communication devices and differentiating distances between the third number of wireless communication devices and the second number of wireless communication devices in order to determine if use of a cleaning device associated with one of the third number of wireless communication devices is to be ascribed to one of the second number of wireless communication devices and reporting therein by an output signal. The third wireless communication device is in communication with the second communication devices for recording and transmitting the monitoring data generated to a wireless communication module and data server for processing.

A fourth number of wireless communication devices being disposed at access points of rooms or at the perimeter boundaries of zones and operative for recognizing the presence and uniqueness of the second number of wireless communication devices and differentiating distances between the fourth number of wireless communication devices and the second number of wireless communication devices in order to determine if an object or person traversing perimeter boundaries of said zones or access points of rooms associated with the fourth number of wireless communication devices is to be ascribed to one of the second wireless communication devices and reporting therein by an output signal. The fourth wireless communication device has a unique identifier associated with it and ascribing it to an access point or perimeter location of a defined zone. The fourth wireless communication device is in communication with the second communication devices for recording and transmitting the monitoring data generated to a wireless communication module and data server for processing.

Photoelectric emitter and receiver pairs being disposed at access points of rooms or at the perimeter boundaries of zones and operative such that light beams are established between the photoelectric detector pairs. A plurality of photoelectric emitter and receiver pairs being disposed at access points of rooms or at the perimeter boundaries of zones and operative such that multiple discrete light beams are established in a horizontal plane between the photoelectric detector pairs. The photoelectric emitter and receiver pair is in communication with the fourth communication devices and operative for establishing an interruption in the light beam and communicating said interruption to the fourth wireless communication device. The photoelectric emitter and receiver pair is in communication with the fourth communication devices and operative such that the fourth wireless communication is informed of the interruption in the photoelectric receiver and emitter light beam continuity thus initiating the receiving of communication from the second wireless communication device in an object or person traversing the room access point or zone boundary defined by said interruption in the photoelectric receiver and emitter light beam continuity.

Monitored data available include the identity of tags whose signal is being received; the location of the interruption in the photoelectric receiver and emitter light beam continuity, the date and time of an interruption in the photoelectric receiver and emitter light beam continuity, the speed and the direction of the interruption in the light beam. The fourth wireless communication device is operative for recording and transmitting the monitoring data generated to a wireless communication module and data server for processing.

The invention includes one or many of a plurality of cleaning or sanitation devices or facilities. Such sanitation devices may include paper dispensers, water closets, sinks, faucets, pressure washers, hoses, wash down nozzles, vacuums, mops, apparel dispensers and soap or sanitizer dispensers.

In order to manage the prevention of cross-contamination events and the related use of sanitation facilities and monitor the transition of individuals and objects as they traverse boundaries of zones or rooms where segregation of materials within zones or rooms is an important process control requirement; where a process management system capable of remotely monitoring persons and where contamination of material in one zone by material from another zone is unwanted or where cleaning protocols exist to prevent this cross-contamination, a cross-contamination monitoring system in accordance with the present invention may include a plurality of wireless communication devices with a first number of the wireless communication devices being disposed within or adjacent cleaning devices and operative monitoring and reporting the functional status, operational sequence, and consumable content of each sanitation or cleansing device. A second number of wireless communication devices disposed in tags suitable for carrying by individuals or attaching to objects which uniquely identify the individuals or objects. A third number of wireless communication devices being disposed within or adjacent cleaning devices and operative for recognizing the presence and uniqueness of the second number of wireless communication tags and differentiating distances between the third number of wireless communication devices and the tags. A fourth wireless communication device with a unique identifier associated with it and disposed at access points of rooms or at the perimeter boundaries of zones and operative for recognizing the presence and uniqueness of the second number of wireless communication devices and differentiating distances between the fourth number of wireless communication devices and the second number of wireless communication devices in order to determine if an object or person traversing perimeter boundaries of said zones or access points of rooms associated with the fourth number of wireless communication devices is to be ascribed to one of the second wireless communication devices. Photoelectric emitter and receiver pairs disposed at access points of rooms or at the perimeter boundaries of zones and operative such that light beams are established between the photoelectric detector pairs. The photoelectric emitter and receiver pair is in communication with the fourth communication devices and operative such that the fourth wireless communication is informed of the interruption in the photoelectric receiver and emitter light beam continuity thus initiating the receiving of communication from the second wireless communication device associated with an object or person traversing the room access point or zone boundary defined by said interruption in the photoelectric receiver and emitter light beam continuity. The First third and fourth wireless communication devices in communication with a fifth wireless communication device module provided for transmitting to a data server and routed to the processing software where data can be consolidated into useful management information regarding the contamination control process under monitoring.

Functional status, operational sequence, and consumable content of the cleaning devices, identification of the tagged individual or object with respect to proximity of cleaning devices, the unique identity of the tagged object or person traversing perimeter boundaries of zones or access points of rooms, the time, date, speed and direction of said traversal and therefore the state and or relationship between the plurality of elements and tags and therefore adherence with a cross-contamination prevention policy as a managed process. If the software resolves a cross-contamination event, management alerts are sent in real time to a person-in-charge using wireless, internet or common cell phone or pager technology.

BRIEF DESCRIPTION OF THE DRAWINGS

The features and advantages of the present invention are apparent from the following detailed description in conjunction with the accompanying drawings.

DETAILED DESCRIPTION

Figure 1:
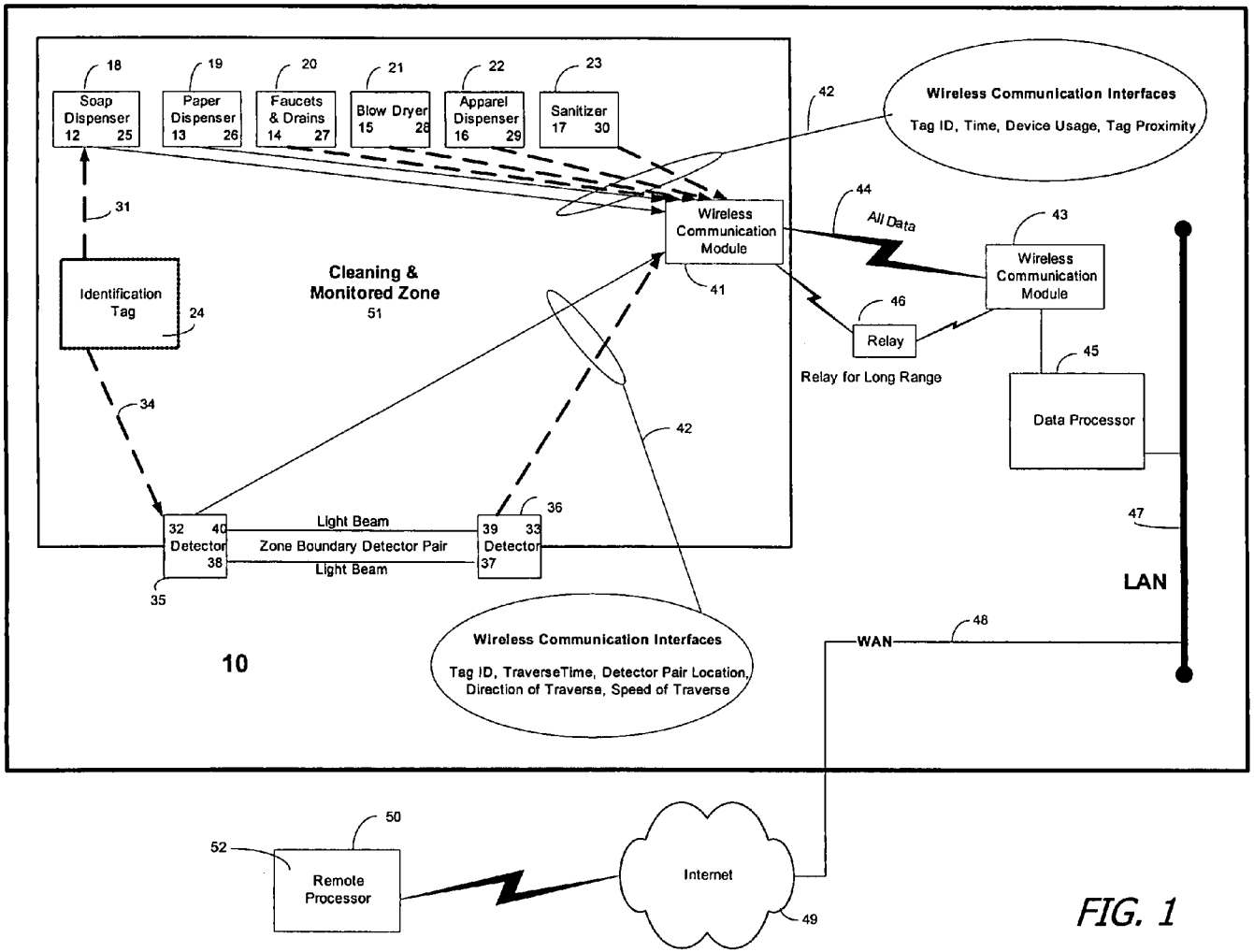
FIG. 1 is a block diagram of a basic cross-contamination monitoring system in accordance with the present invention showing one combined monitored cleaning and cross-contamination control room.

With reference to FIG. 1, there is shown a cross-contamination monitoring system 10 in accordance with the present invention. The system 10 includes a plurality of wireless communication devices which includes a first wireless communication device 12, 13, 14, 15, 16 and 17, adjacent or within cleaning or sanitation devices such as a soap dispenser 18, a paper towel dispenser 19, faucets and drains 20, blow dryer 21, apparel dispenser 22 and sanitizer 23.

In addition, a second number of wireless communication devices 24 may be provided and disposed in tags suitable for carrying by individuals or objects (not shown), for clarity only one of the second number of wireless communication devices 24 is shown in FIG. 1.

The wireless communication devices 24, communicate directly with the third wireless communication devices being disposed within or adjacent cleaning devices 25, 26, 27, 28, 29 and 30 as indicated by the line 31. The third wireless communication device 25, 26, 27, 28, 29 and 30 is configured to recognize a presence of the second wireless communication device 24 and differentiates distances between the third wireless communication device and the second wireless communication device 24 in order to determine if the use of the cleaning or sanitation devices 18, 19, 20, 21, 22 and 23 is to be ascribed to one of the wireless communication device tags 24.

The wireless communication devices 24, communicate directly with the fourth wireless communication devices 32 and 33 as indicated by the line 34. The fourth wireless communication device 32 and 33 is configured to recognize a presence of the second wireless communication device 24 shown by line 34 and differentiates distances between the third wireless communication device and the second wireless communication device 24 in order to determine if object or person traversing perimeter boundaries of said zones or access points 35 and 36 of rooms is to be ascribed to one of the second wireless communication devices 24. Photoelectric emitter and receiver pairs 37, 38, 39 and 40 disposed at access points of rooms or at the perimeter boundaries of zones 35 and 36 and operative such that light beams are established between the photoelectric detector pairs. The photoelectric emitter and receiver pair is in communication with the fourth communication devices 32 and 33 and operative such that the fourth wireless communication is informed of the interruption in the photoelectric receiver and emitter light beam continuity thus initiating the receiving of communication from the second wireless communication device tags 24.

It should be appreciated that the wireless communication devices utilized in accordance with the present invention includes software and electronic circuitry enabling differentiation of distances based on conventional radio frequency electromagnetic wave propagation strength measured between the second wireless communication devices 24 and the third wireless communication devices 25, 26, 27, 28, 29, 30 and between the second wireless communication devices 24 and the fourth wireless communication devices 32 and 33.

The first third and fourth wireless communication devices are in communication with a fifth wireless communication device module 41 located in the monitored zone as shown by bundle of lines 42 for recording an input signal The output signal is consolidated and transmitted to a receiver 43 as shown by lines 44 provided for transmitting to a data processor 45.

If the receiver 43, is outside the range of the wireless communication device 41, a further wireless communication device or relay, 46 may be utilized to relay the signal.

Remote monitoring of the status, use and sanitation protocol process compliance in the cleaning and monitored zones may be accomplished through a connection to a local area network 47 which in turn may be connected through a wide area network 48 to the internet 49, which in turn is accessible through a remote management work station and computing device 50 containing the processing software 52 where data can be consolidated into useful management information regarding the contamination control process under monitoring.

An individual or object traversing the boundary 35 and 36 of the cleaning and monitored zone 51 wearing or having the tag 24 attached can be monitored and identified in relation to said boundaries 35 and 36 and in relationship with the cleaning or sanitation devices 18, 19, 20, 21, 22 and 23. Monitoring of the cleaning or sanitation devices 18, 19, 20, 21, 22 and 23 evaluates the status of the device for the purpose of determining sequence of operation, operational status, diagnostic analysis, consumable content level. Monitoring the zone boundary 35 and 36 traversal point evaluates the individual or object identity to determine authorization to traverse said boundary. The time, date, speed and direction of said traversal and therefore the state and or relationship between the plurality of elements and tags and therefore adherence with a cross-contamination prevention policy as a managed process can be determined. If the software 52 resolves a cross-contamination event, management alerts are sent in real time to a person-in-charge using wireless, internet or common cell phone or pager technology.

Figure 2:
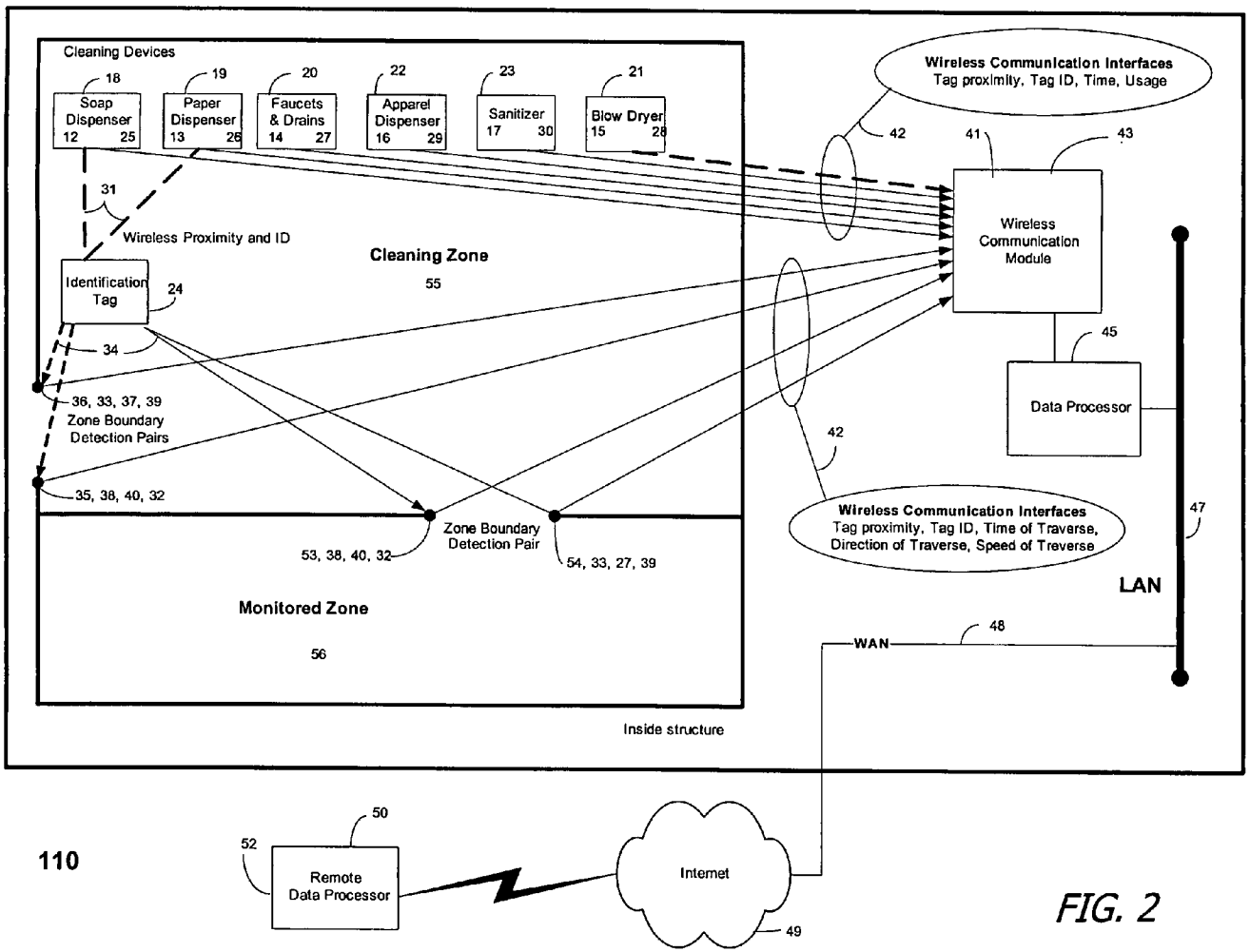
FIG. 2 is a block diagram of a cross-contamination monitoring system in accordance with the present invention showing one monitored cross-contamination control zone and one cleaning zone.

With reference to FIG. 2, there is shown a sanitation appliance monitoring system 110 in accordance with the present invention in which common elements of FIG. 1 are represented by common reference characters. The system 110 includes a plurality of wireless communication devices which includes a first wireless communication device 12, 13, 14, 15, 16 and 17, adjacent or within cleaning or sanitation devices such as a soap dispenser 18, a paper towel dispenser 19, faucets and drains 20, blow dryer 21, apparel dispenser 22 and sanitizer 23.

In addition, a second number of wireless communication devices 24 may be provided and disposed in tags suitable for carrying by individuals or objects (not shown), for clarity only one of the second number of wireless communication devices 24 is shown in FIG. 2.

The wireless communication devices 24, communicate directly with the third wireless communication devices being disposed within or adjacent cleaning devices 25, 26, 27, 28, 29 and 30 as indicated by the line 31. The third wireless communication device 25, 26, 27, 28, 29 and 30 is configured to recognize a presence of the second wireless communication device 24 shown by line 31 and differentiates distances between the third wireless communication device and the second wireless communication device 24 in order to determine if the use of the cleaning or sanitation devices 18, 19, 20, 21, 22 and 23 is to be ascribed to one of the wireless communication device tags 24.

The wireless communication devices 24, communicate directly with the fourth wireless communication devices 32 and 33 as indicated by the line 34. The fourth wireless communication device 32 and 33 is configured to recognize a presence of the second wireless communication device 24 and differentiates distances between the third wireless communication device and the second wireless communication device 24 in order to determine if object or person traversing perimeter boundaries of said zones or access points 35 and 36 or 53 and 54 of rooms is to be ascribed to one of the second wireless communication devices 24. Photoelectric emitter and receiver pairs 37, 38, 39 and 40 disposed at access points of rooms or at the perimeter boundaries of zones 35 and 36 or 53 and 54 operative such that light beams are established between the photoelectric detector pairs. The photoelectric emitter and receiver pair is in communication with the fourth communication devices 32 and 33 and operative such that the fourth wireless communication is informed of the interruption in the photoelectric receiver and emitter light beam continuity thus initiating the receiving of communication from the second wireless communication device tags 24.

It should be appreciated that the wireless communication devices utilized in accordance with the present invention includes software and electronic circuitry enabling differentiation of distances based on conventional radio frequency electromagnetic wave propagation strength measured between the second wireless communication devices 24 and the third wireless communication devices 25, 26, 27, 28, 29, 30 and between the second wireless communication devices 24 and the fourth wireless communication devices 32 and 33.

The First third and fourth wireless communication devices are in communication with a fifth wireless communication device module 41 outside the cleaning and monitored zone as shown by bundle of lines 42 for recording an input signal. The output signal is consolidated and transmitted directly to an integral receiver 43 provided for transmitting to a data processor 45.

Remote monitoring of the status, use and sanitation protocol process compliance in the cleaning and monitored zones may be accomplished through a connection to a local area network 47 which in turn may be connected through a wide area network 48 to the internet 49, which in turn is accessible through a remote management work station and computing device 50 containing the processing software 52 where data can be consolidated into useful management information regarding the contamination control process under monitoring.

An individual or object traversing the boundary 35 and 36 of the cleaning zone 55 wearing or having the tag 24 attached can be monitored and identified in relation to said boundaries 35 and 36 and in relationship with the cleaning or sanitation devices 18, 19, 20, 21, 22 and 23. Monitoring of the cleaning or sanitation devices 18, 19, 20, 21, 22 and 23 evaluates the status of the device for the purpose of determining sequence of operation, operational status, diagnostic analysis, consumable content level. Monitoring the zone boundary 35 and 36 and 53 and 54 traversal point evaluates the individual or object identity to determine authorization to traverse said boundary. The time, date, speed and direction of said traversal and therefore the state and or relationship between the plurality of elements and tags and therefore adherence with a cross-contamination prevention policy as a managed process can be determined. For example, a specific sanitation protocol may be required involving a sequence of use of cleaning devices associated with the individual or object identified by the tag 24 before said individual or object traverses the zone boundary established by 53 and 54 into the monitored zone 56. If the software 52 resolves a cross-contamination event, management alerts are sent in real time to a person-in-charge using wireless, internet or common cell phone or pager technology.

Figure 3:
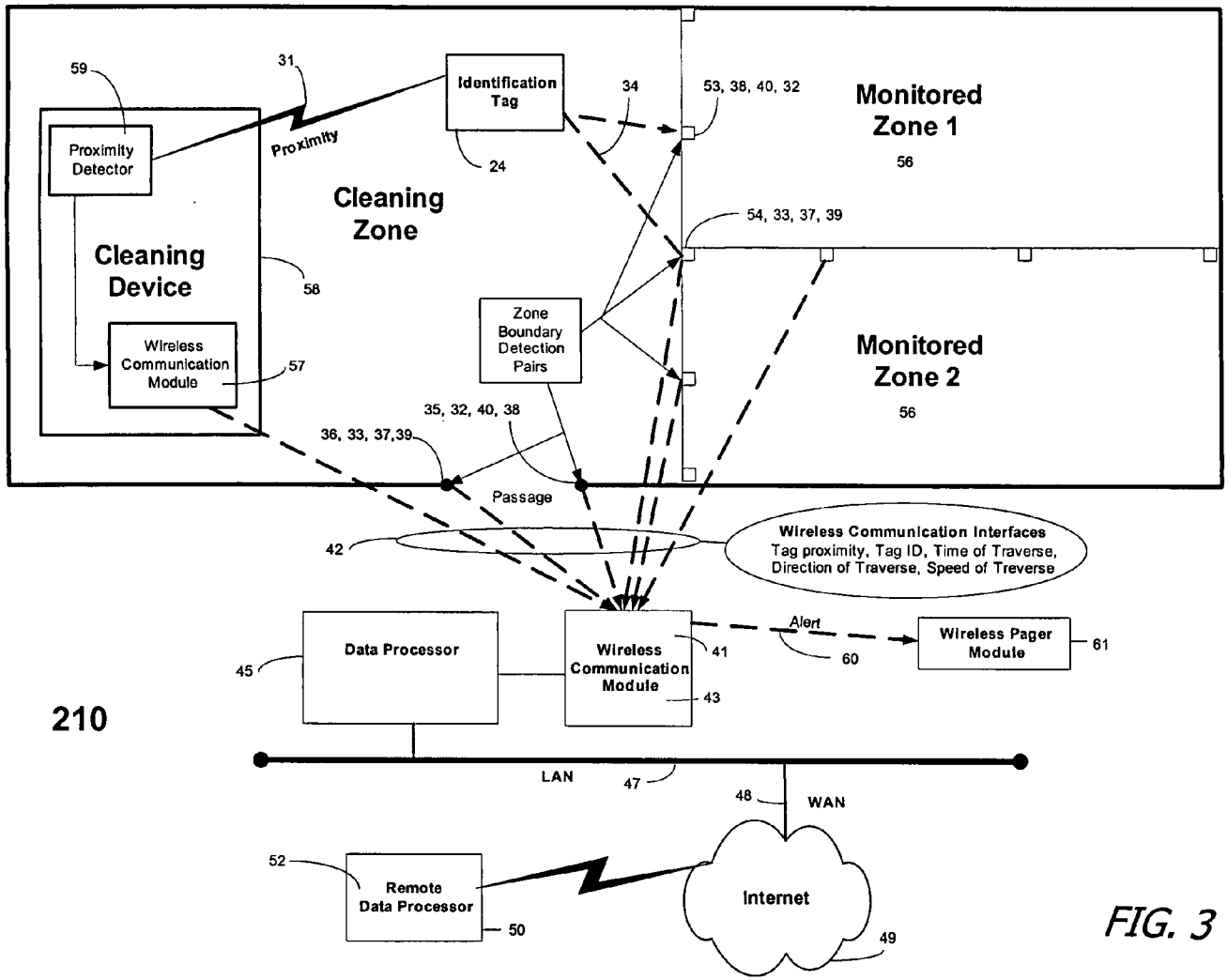
FIG. 3 is a block diagram of a cross-contamination monitoring system in accordance with the present invention showing two monitored cross-contamination control zones and one cleaning zone with a single representative sanitation or cleaning device.

With reference to FIG. 3, there is shown an alternative embodiment 210 of a system in accordance with the present invention in which common elements in FIGS. 1 & 2 are represented by common reference characters.

With reference to FIG. 3, there is shown a cross-contamination monitoring system 210 in accordance with the present invention. In this representation there are a plurality of cross-contamination monitoring zones and a single cleaning zone. The system 210 includes a plurality of wireless communication devices which includes a first wireless communication device 57, adjacent or within cleaning or sanitation device 58.

In addition, a second number of wireless communication devices 24 may be provided and disposed in tags suitable for carrying by individuals or objects (not shown), for clarity only one of the second number of wireless communication devices 24 is shown in FIG. 3.

The wireless communication devices 24, communicate directly with the third wireless communication device 59, being disposed within or adjacent cleaning device 58 as indicated by the line 31. The third wireless communication device 59 is configured to recognize a presence of the second wireless communication device 24 and differentiates distances between the third wireless communication device and the second wireless communication device 24 in order to determine if the use of the cleaning or sanitation devices 58 is to be ascribed to one of the wireless communication device tags 24.

The wireless communication devices 24, communicate directly with the fourth wireless communication devices 32 and 33 as indicated by the line 34. The fourth wireless communication device 32 and 33 is configured to recognize a presence of the second wireless communication device 24 shown by line 34 and differentiates distances between the third wireless communication device and the second wireless communication device 24 in order to determine if object or person traversing perimeter boundaries of said plurality of zones or access points 35 and 36 or 53 and 54 of rooms is to be ascribed to one of the second wireless communication devices 24. Photoelectric emitter and receiver pairs 37, 38, 39 and 40 disposed at a plurality of access points of rooms or at the perimeter boundaries of zones 35 and 36 or 53 and 54 operative such that light beams are established between the photoelectric detector pairs. The photoelectric emitter and receiver pair is in communication with the fourth communication devices 32 and 33 and operative such that the fourth wireless communication is informed of the interruption in the photoelectric receiver and emitter light beam continuity thus initiating the receiving of communication from the second wireless communication device tags 24.

It should be appreciated that the wireless communication devices utilized in accordance with the present invention includes software and electronic circuitry enabling differentiation of distances based on conventional radio frequency electromagnetic wave propagation strength measured between the second wireless communication devices 24 and the third wireless communication devices 59 and between the second wireless communication devices 24 and the fourth wireless communication devices 32 and 33.

The First third and fourth wireless communication devices are in communication with a fifth wireless communication device module 41 outside the cleaning and monitored zone as shown by bundle of lines 42 for recording an input signal. The output signal is consolidated and transmitted directly to an integral receiver 43 provided for transmitting to a data processor 45.

Remote monitoring of the status, use and sanitation protocol process compliance in the cleaning and monitored zones may be accomplished through a connection to a local area network 47 which in turn may be connected through a wide area network 48 to the internet 49, which in turn is accessible through a remote management work station and computing device 50 containing the processing software 52 where data can be consolidated into useful management information regarding the contamination control process under monitoring.

An individual or object traversing the boundary 35 and 36 of the cleaning zone 55 wearing or having the tag 24 attached can be monitored and identified in relation to said boundaries 35 and 36 and in relationship with the cleaning or sanitation device 58. Monitoring of the cleaning or sanitation device 58, evaluates the status of the device for the purpose of determining sequence of operation, operational status, diagnostic analysis, consumable content level. Monitoring the zone boundary 35 and 36 and 53 and 54 traversal point evaluates the individual or object identity to determine authorization to traverse said boundary. The time, date, speed and direction of said traversal and therefore the state and or relationship between the plurality of elements and tags and therefore adherence with a cross-contamination prevention policy as a managed process can be determined. For example, a specific sanitation protocol may be required involving a sequence of use of cleaning devices associated with the individual or object identified by the tag 24 before said individual or object traverses the zone boundary established by 53 and 54 into the monitored zones 56. If the software 52 resolves a cross-contamination event, management alerts 60 are sent in real time to a person-in-charge using wireless, internet or common cell phone or pager 61 technology.

The wireless communication devices are short range (30 to 300 feet), radio frequency (RF) radio devices designed for point to point communication. These devices operate in the Industrial, Scientific & Medical (ISM) frequency bands. These devices are designed to consume little power, drawing less than 10 mA when transmitting, and therefore have long battery life. Because the data creation rate (bandwidth) of the appliances being monitored is low, the transmission rate of the transmitter is low, typically below 1 kbps. A low transmission rate consumes less power and enables a less sophisticated and less expensive microprocessor. The RF devices suitable for use in the present invention include but are not limited to those available from many sources. Atmel Corporation, San Jose, Calif., LINX Technologies, Grants Pass, Oreg., Cypress Semiconductor, San Jose, Calif., RF Monolithics, Dallas Tex., Chipcon, Oslo, Norway. While the technology rapidly advances, Radiotronix, Moore, Okla. currently offers the preferred device in their model number RCT-433-AS.

Wireless communication devices and LAN gateways suitable for use in the present invention are generally sophisticated RF transceiver devices with internal microprocessors. This sophisticated device is used as a single collecting node or as a relay in a larger network of many similar devices. These devices communicate in a way determined by a communication protocol stored in the microprocessor. The protocol can be a proprietary design as demonstrated by the Zensys product or follow an industry standard assuring interoperability as demonstrated by IEEE Standard 802.15.4 known as ZigBee or IEEE standard 802.11 known as WiFi or IEEE standard 801.16 known as WiMax. This network is typically extends the range and reliability of the sensing system by transferring the data from node to node over multiple redundant paths to the final device connected to the LAN. These devices are more expensive than the RF transmitter discussed previously due to their complexity. They consume more power, drawing as much as 36 mA when transmitting. They are designed to carry a higher data Bandwidth of as much as 250 kbps. The devices are available from many sources including Crossbow Technology, San Jose, Calif., Dust, Berkeley, Calif., Ember, Boston, Mass., ZMD GMBH, Dresden, Germany and Linksys, Irvine, Calif.

It should be appreciated that the facility Local Area Network (LAN) is a generic term referring to many possible forms, implementation schemes and hybrids describing a method of connectivity to a wide area network (WAN). Several typical examples of connection media are, Twisted Wire Pair Cable, Fiber Optic Cable, Coaxial Cable, Wireless and Power Line.

It should also be appreciated that the Wide Area Network (WAN) is a generic term referring to many possible forms, implementation schemes and hybrids describing a method of connectivity to a remote database computing center. Examples of a Wide Area Network include the internet, the wired telephone system and the wireless cell phone system.

The forgoing description of the system for monitoring and recording cross-contamination events has been presented for the purpose of illustration and description. It is not intended to be exhaustive or to limit the invention to the precise form disclosed. Many modifications and variations are possible in light of the above teachings. Pursuant to the above, it is to be understood that the drawings and descriptions herein are presented by way of example to facilitate comprehension of the invention and should not be construed to limit the scope thereof. It is also understood that the following claims are to cover all generic and specific features of the invention described herein and all statements of the invention which as a matter of language, might be said to fall there between. Accordingly, any and all modifications, variations or equivalent arrangements which may occur to those skilled in the art, should be considered to be within the scope of the present invention as defined in the appended claims.

What is claimed is:

1. A cross-contamination management system for remotely monitoring of personnel and objects and their use of sanitation facilities comprising:

a plurality of wireless communication devices, a first number of the wireless communication devices being disposed within or adjacent cleaning devices and operative for monitoring and reporting status and operation thereof;

a second number of the wireless communication devices being disposed in tags suitable for carrying by individuals or attached to objects;

a third number of wireless communication devices being disposed within or adjacent cleaning devices configured for recognizing a presence of the second number of wireless communication devices and differentiating distances between the second number of wireless communication devices and the third number of wireless communication devices in order to determine if use of a cleaning device associated with one of the first number of wireless communication devices is to be ascribed to one of the tags and reporting thereon by an output signal;

the third wireless communication device configured for communication with the second wireless communication devices for recording and transmitting a consolidated output signal; A fourth wireless communication device with a unique identifier associated with it and disposed at access points of rooms or at the perimeter boundaries of zones and operative for recognizing the presence and uniqueness of the second number of wireless communication devices and differentiating distances between the fourth number of wireless communication devices and the second number of wireless communication devices in order to determine if an object or person traversing perimeter boundaries of said zones or access points of rooms associated with the fourth number of wireless communication devices is to be ascribed to one of the second wireless communication devices;

one or more photoelectric emitter and receiver pairs disposed at access points of rooms or at the perimeter boundaries of zones and operative such that light beams are established between the photoelectric emitter and receiver pairs, the photoelectric emitter and receiver pairs being in communication with the fourth communication devices and operative such that the fourth wireless communication devices are informed of the interruption in a photoelectric receiver and emitter light beam continuity thus initiating the receiving of communication from the second wireless communication device associated with an object or person traversing the room access point or zone boundary defined by the interruption in the photoelectric receiver and emitter light beam continuity;

the first, third and fourth wireless communication devices being in communication with a fifth wireless communication device module provided for transmitting to a data server and routed to processing software where data can be consolidated into useful management information regarding the cross-contamination control process under monitoring.

2. The system according to claim 1, wherein the configuration of the third and fourth number of wireless communication devices includes circuitry and software for enabling differentiation of distances based on conventional radio frequency electromagnetic wave propagation strength as emitted from the second number of wireless communication devices and resolved by the third and fourth number of wireless communication devices.

* * * * *